US008038412B2

(12) United States Patent
Durtschi

(10) Patent No.: US 8,038,412 B2
(45) Date of Patent: Oct. 18, 2011

(54) TEMPERATURE MANAGEMENT FOR ELECTRIC MOTOR DRIVEN PUMP

(75) Inventor: William G. Durtschi, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 391 days.

(21) Appl. No.: 11/758,722

(22) Filed: Jun. 6, 2007

(65) Prior Publication Data

US 2008/0304976 A1 Dec. 11, 2008

(51) Int. Cl.
*F04B 49/00* (2006.01)

(52) U.S. Cl. ..... 417/14; 417/32; 60/782

(58) Field of Classification Search ..... 417/12, 417/14, 32, 53; 244/134 B, 134 R; 60/782; 123/142.5 R, 549, 142.5 E; 310/11, 54, 58, 310/52, 16, 12.29, 216.119, 297, 417; 318/68 C, 318/436
See application file for complete search history.

(56) References Cited

U.S. PATENT DOCUMENTS

| | | | | |
|---|---|---|---|---|
| 3,582,712 | A | 6/1971 | Blair | |
| 3,774,096 | A | 11/1973 | Hann | |
| 3,959,692 | A | 5/1976 | Wetzel | |
| 4,135,122 | A | 1/1979 | Holmquist et al. | |
| 4,294,228 | A * | 10/1981 | Kruger et al. | 126/609 |
| 4,355,269 | A | 10/1982 | Burton et al. | |
| 4,808,896 | A * | 2/1989 | Katsuragi et al. | 318/436 |
| 4,835,715 | A * | 5/1989 | Bench et al. | 700/278 |
| 5,103,649 | A * | 4/1992 | Kieffer | 62/136 |
| 5,158,436 | A * | 10/1992 | Jensen et al. | 417/32 |
| 5,667,051 | A * | 9/1997 | Goldberg et al. | 192/85 R |
| 5,708,336 | A * | 1/1998 | Eyerly et al. | 318/436 |
| 5,845,848 | A * | 12/1998 | Amako et al. | 239/129 |
| 5,959,428 | A * | 9/1999 | Saito et al. | 318/705 |
| 6,318,467 | B1 * | 11/2001 | Liu et al. | 166/302 |
| 6,400,522 | B1 | 6/2002 | Milligan | |
| 6,642,682 | B1 | 11/2003 | Perkins et al. | |
| 6,725,707 | B1 * | 4/2004 | Lin et al. | 73/54.01 |
| 6,735,035 | B1 | 5/2004 | Smith et al. | |
| 7,451,753 | B2 * | 11/2008 | Bell et al. | 123/601 |

(Continued)

FOREIGN PATENT DOCUMENTS

JP 7063184 A * 3/1995

(Continued)

*Primary Examiner* — Devon C Kramer
*Assistant Examiner* — Nathan Zollinger
(74) *Attorney, Agent, or Firm* — Carlson, Gaskey & Olds PC

(57) ABSTRACT

A hydraulic pump system is provided that includes a pump driven by an electric motor. The electric motor includes windings that receive power from a power source. In one example, a temperature sensor is arranged in proximity to hydraulic fluid associated with the pump, such as at an input of the pump. In another example, the temperature sensor measures the ambient temperature to predict the viscosity of the pump based upon cool down rates of the system. A controller monitors a temperature at the temperature sensor and commands power to be provided to the windings to generate heat. Electric motor power consumption can be monitored to determine viscosity. The heat reduces the viscosity of the hydraulic fluid. Bleed air may be selectively provided to a casing associated with the hydraulic fluid in response to a command from the controller. The controller actuates a valve to regulate the flow of bleed air to the casing to provide supplemental heat to the heat provided by the windings. In this manner, the viscosity of the hydraulic fluid is more efficiently managed to provide desired startup of the pump in cold conditions.

5 Claims, 1 Drawing Sheet

U.S. PATENT DOCUMENTS

| | | | | |
|---|---|---|---|---|
| 2002/0100775 | A1 | 8/2002 | Estelle et al. | |
| 2004/0027012 | A1 * | 2/2004 | Sangha | 310/58 |
| 2006/0021340 | A1 | 2/2006 | Vigholm et al. | |

FOREIGN PATENT DOCUMENTS

| | | |
|---|---|---|
| JP | 2004183539 | 7/2004 |
| WO | 90/06440 | 6/1990 |

* cited by examiner

TEMPERATURE MANAGEMENT FOR ELECTRIC MOTOR DRIVEN PUMP

BACKGROUND OF THE INVENTION

This invention relates to a method and apparatus for managing the temperature of a hydraulic pump that uses an electric motor.

In aircraft and other applications, electrical motor driven pumps are used to provide or supplement hydraulic power for actuators and other hydraulically or fluid powered components. In many cases, these pumps are inactive for long periods in cold environments and then are expected to startup rapidly and provide full performance in a very short period of time.

In cold environments, the hydraulic fluid becomes very viscous so that starting the pump under sustained cold conditions is difficult. To decrease the viscosity of the fluid and enable desired startup of the pump, it is typical to either run the pump continuously or to provide the pump with a continuous flow of hot gases, typically bleed air from a turbine engine. Continuously running the pump decreases the life of it and the electric motor. Providing a continuous flow of bleed air decreases the efficiency of the source providing the bleed air.

To avoid the above problems, power sufficient to provide a stall torque to the electric motor has been used to generate heat using the windings of the electric motor. Similar to the solutions described above, the power is provided to the electric motor continuously, which is inefficient. What is needed is an efficient hydraulic pump and electric motor system that reduces the viscosity of the hydraulic fluid on an as-needed basis.

SUMMARY OF THE INVENTION AND ADVANTAGES

A hydraulic pump system for an aircraft is provided that includes a pump driven by an electric motor. The electric motor includes windings that receive power from a power source. In one example, a temperature sensor is arranged in proximity to hydraulic fluid associated with the pump, such as at an input of the pump. The windings are used as the temperature sensor, in one example. In another example, the temperature sensor measures the ambient temperature to predict the viscosity of the pump based upon cool down rates of the system. A controller monitors a temperature at the temperature sensor and commands power to be provided to the windings to generate heat. The heat reduces the viscosity of the hydraulic fluid. Bleed air may be selectively provided to a casing associated with the hydraulic fluid in response to a command from the controller. The controller actuates a valve to regulate the flow of bleed air to the casing to provide supplemental heat to the heat provided by the windings.

In another example, the electric motor is rotated and the power to the electric motor is monitored to determine the viscosity of the hydraulic fluid. Heat is applied to the hydraulic fluid if the power consumption corresponds to an undesired viscosity. In this manner, the viscosity of the hydraulic fluid is more efficiently managed to provide desired startup of the pump in cold conditions.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
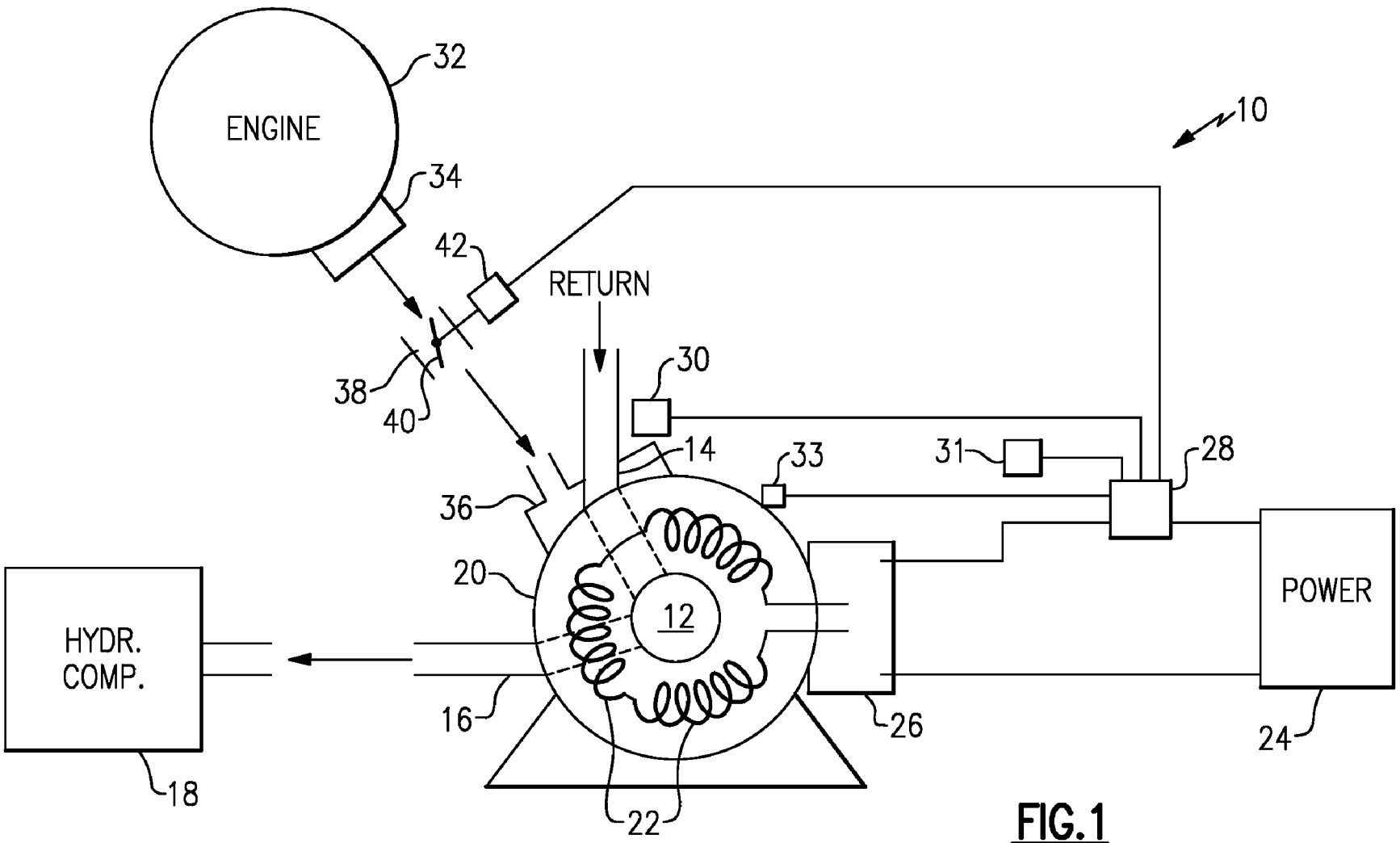
FIG. 1 is a schematic view of an example hydraulic pump and electric motor system.

A hydraulic pump and electric motor system 10 is shown in FIG. 1. The system 10 includes a pump 12 having an inlet 14 and an outlet 16. In one example, the pump 12 provides hydraulic fluid to one or more hydraulic components 18 through the outlet 16. An electric motor 20 rotationally drives the pump 12 and is typically arranged concentrically with the pump 12 in a common housing, in one example. The electric motor 20 must overcome the viscosity of the hydraulic fluid within the pump 12 and the hydraulic fluid entering it through the inlet 14. In sustained cold conditions, it is often necessary to heat the hydraulic fluid to reduce its viscosity so that pump 12 can operate in a desired manner during startup. For one example hydraulic fluid, a start up temperature of about 0° C. is desirable.

The electric motor 20 includes windings 22 that, when energized, rotate a rotor driving the pump 12, as is known in the art. Current is provided to the windings 22 from a power source 24 that passes through an inverter 26 or motor relay, for example.

A controller 28 is schematically shown in FIG. 1 as part of a circuit providing power to the electric motor 20. The controller 28 selectively provides power to the electric motor 20 in response to sensed conditions. In one example, a temperature sensor 30 is arranged to detect the temperature of hydraulic fluid entering or within the pump 12 in a closed loop arrangement. The temperature sensed by the temperature sensor 30 corresponds to a viscosity of the hydraulic fluid. The windings 22 can also be used as a temperature sensor by detecting the resistance of the windings 22, which can be correlated to a temperature.

In another example, the controller 28 can monitor an ambient temperature using temperature sensor 31 in an open loop arrangement to predict the viscosity of the hydraulic fluid based upon the temperatures and the duration of time the hydraulic system has been inoperable and exposed to the cold conditions. For example, cool down rates of the hydraulic system can be empirically determined. The cool down rates together with the ambient temperature and inoperable time is used to estimate the temperature of the hydraulic fluid. The viscosity of the hydraulic fluid can be modeled based upon this and other information.

The controller 28 provides power to the electric motor 20 by energizing the windings 22 to generate heat with the windings 22 when an undesired viscosity is predicted. In this manner, the hydraulic fluid associated with the pump 12 can be heated when it is too viscous for desired start up. In one example, the windings 22 are energized such that heat is generated, but the electric motor 20 does not rotate. In one example, a rotational sensor 33 can be connected to the controller 28 to monitor the rotation of the electric motor 20 to insure there is no undesired rotation. In another example, the pump 12 is rotated by the electric motor 20 to monitor the power consumed, which can be correlated to the viscosity of the hydraulic fluid. If the power consumption to rotate the electric motor 20 corresponds to an undesired viscosity, then rotation is stopped and the pump 12 is heated.

Under some conditions, the heat provided by the windings 22 may be insufficient to adequately reduce the viscosity of the hydraulic fluid. For example, cavitation at the inlet 14 can be a problem after extreme cold soak conditions when the inlet lines are remote from the pump 12 and not well insulated. As a result, it may be desirable to further heat the hydraulic fluid. In one example, bleed air from a bleed air source 34, such as a turbine engine 32, may be provided to a casing 36 associated with pump 12. The casing 36 can heat the fluid within the pump 12 and hydraulic fluid associated with the inlet 14. A valve 40 is arranged within a passageway 38 to selectively provide bleed air to the casing 36 using an actuator 42, which is regulated by the controller 28. In this manner, the temperature of the pump 12 is efficiently managed using heat selectively provided by the electric motor and bleed air selectively provided from a bleed air source.

Although a preferred embodiment of this invention has been disclosed, a worker of ordinary skill in this art would recognize that certain modifications would come within the scope of this invention. For example, although physical connections are shown between many of the elements in FIG. 1, it should be understood that the components may communicate with one another wirelessly. For that reason, the following claims should be studied to determine the true scope and content of this invention.

What is claimed is:

1. A hydraulic pump system comprising:

a pump configured to be driven by an electric motor and pump a fluid, the electric motor including windings;

a power source connected to the windings;

a temperature sensor for monitoring an ambient temperature, wherein the temperature sensor is configured to be arranged external to the fluid; and a controller programmed to selectively provide power to the windings in response to a temperature sensed by the temperature sensor to heat the fluid, wherein the controller determines an inoperable system time and estimates the viscosity of the fluid based upon the ambient temperature, the inoperable system time and a cool down rate of the hydraulic pump system, the power provided to the windings when the viscosity reaches an undesired viscosity.

2. A hydraulic pump system comprising:

a pump configured to be driven by an electric motor, the electric motor including windings;

a power source connected to the windings;

a temperature sensor for monitoring a temperature; and a controller programmed to selectively provide power to the windings in response to a temperature sensed by the temperature sensor to heat a fluid associated with the pump, wherein a casing is associated with the pump, and a passageway selectively provides bleed air to the casing when the power provided to the windings is insufficient to heat the fluid from an undesired viscosity to a desired viscosity.

3. The system according to claim 2, wherein a valve is arranged within the passageway and an actuator manipulates the valve in response to a command from the controller to selectively provide bleed air to the casing.

4. The system according to claim 2, comprising a turbine engine providing the bleed air.

5. The system according to claim 4, comprising an aircraft hydraulic component receiving the fluid from the pump.

* * * * *